US010668743B2

(12) United States Patent
Tanemoto et al.

(10) Patent No.: US 10,668,743 B2
(45) Date of Patent: Jun. 2, 2020

(54) PRINTING APPARATUS, AND ELONGATE PRINTING PAPER TRANSPORTING METHOD FOR PRINTING APPARATUS

(71) Applicant: SCREEN HOLDINGS CO., LTD., Kyoto (JP)

(72) Inventors: Mitsuru Tanemoto, Kyoto (JP); Susumu Takahashi, Kyoto (JP); Shoji Kakimoto, Kyoto (JP)

(73) Assignee: SCREEN HOLDINGS CO., LTD., Kyoto (JP)

( * ) Notice: Subject to any disclaimer, the term of this patent is extended or adjusted under 35 U.S.C. 154(b) by 0 days.

(21) Appl. No.: 16/356,513

(22) Filed: Mar. 18, 2019

(65) Prior Publication Data

US 2019/0291469 A1 Sep. 26, 2019

(30) Foreign Application Priority Data

Mar. 26, 2018 (JP) ..... 2018-058434

(51) Int. Cl.
*B41J 11/00* (2006.01)
*B41J 15/16* (2006.01)

(52) U.S. Cl.
CPC ..... *B41J 11/002* (2013.01); *B41J 15/16* (2013.01)

(58) Field of Classification Search
CPC ..... B41J 11/002; B41J 15/16; B41J 29/377
See application file for complete search history.

(56) References Cited

U.S. PATENT DOCUMENTS

2009/0237478 A1* 9/2009 Hara ..... B41J 11/0015 347/102
2014/0104360 A1* 4/2014 Hacker ..... B41J 3/60 347/104

FOREIGN PATENT DOCUMENTS

JP 2016-186342 A 10/2016

* cited by examiner

*Primary Examiner* — Henok D Legesse
(74) *Attorney, Agent, or Firm* — McDermott Will & Emery LLP

(57) ABSTRACT

At least one of an upstream drive roller and a downstream drive roller is operated, after printing on web paper and at a time of transportation halt of the web paper, to make a tension value of the web paper between the upstream drive roller and downstream drive roller lower than a tension value at a time of transporting the web paper, so that at least part of contact portions of the web paper in contact with five cooling rollers separate from the five cooling rollers. Consequently, gaps can be produced between the contact portions of the web paper in contact with the five cooling rollers and the five cooling rollers. This can reduce waterdrops due to dew condensation adhering to the web paper. As a result, paper break can be inhibited at a time of starting transportation of the web paper.

7 Claims, 5 Drawing Sheets

PRINTING APPARATUS, AND ELONGATE PRINTING PAPER TRANSPORTING METHOD FOR PRINTING APPARATUS

CROSS-REFERENCE TO RELATED APPLICATIONS

This application claims priority to Japanese Patent Application No. 2018-058434 filed Mar. 26, 2018, the subject matter of which is incorporated herein by reference in entirety.

BACKGROUND OF THE INVENTION

Technical Field

This invention relates to a printing apparatus for printing on elongate printing paper, and an elongate printing paper transporting method for a printing apparatus.

Description of the Related Art

An inkjet printing apparatus is known as a type of printing apparatus. The inkjet printing apparatus includes a transport mechanism for transporting elongate printing paper, and a plurality of print heads for dispensing ink droplets to the elongate printing paper.

The inkjet printing apparatus further includes a heating roller (drying unit) for drying the elongate printing paper carrying ink droplets adhering thereto, and a cooling unit for cooling the elongate printing paper heated by the heating roller. The cooling unit includes a plurality of cooling rollers (also called chiller rollers) having a cooling function (see Japanese Unexamined Patent Publication No. 2016-186342, for example).

SUMMARY OF INVENTION

The elongate printing paper heated by the heating roller reaches a high temperature. The plurality of cooling rollers are therefore effective in cooling the elongate printing paper at the high temperature. However, dew condensation occurs to the cooling rollers. Especially when the transportation of the elongate printing paper stops after printing is completed, dew condensation tends to be caused by the influence of the heat of the elongate printing paper and humidity due to the ink droplets. With waterdrops due to the dew condensation continuing to adhere to contact portions of the elongate printing paper in contact with the cooling rollers when the transportation of the elongate printing paper is stopped, there is a possibility of paper break at the time of starting the transportation of the elongate printing paper.

This invention has been made having regard to the state of the art noted above, and its object is to provide an printing apparatus and an elongate printing paper transporting method for a printing apparatus which can inhibit paper break due to dew condensation.

Solution to Problem

To fulfill the above object, this invention provides the following construction. A printing apparatus for printing on elongate printing paper, according to this invention, comprises a printing unit for printing on the elongate printing paper; a drying unit for heating and drying print portions of the elongate printing paper printed by the printing unit; a plurality of cooling rollers for cooling the print portions heated by the drying unit; an upstream drive roller located in a position upstream of and adjacent the cooling rollers for transporting the elongate printing paper; a downstream drive roller located in a position downstream of and adjacent the cooling rollers for transporting the elongate printing paper; and a controller for making a tension value of the elongate printing paper between the upstream drive roller and the downstream drive roller lower than a tension value at a time of transportation of the elongate printing paper by controlling at least one of the upstream drive roller and the downstream drive roller after the printing on the elongate printing paper and at a time of transportation halt of the elongate printing paper, so that at least part of contact portions of the elongate printing paper in contact with the cooling rollers separate from the cooling rollers.

According to the printing apparatus in this invention, at least one of the upstream drive roller and downstream drive roller is operated, after the end of printing on the elongate printing paper and at the time of transportation halt of the elongate printing paper, to make the tension value of the elongate printing paper between the upstream drive roller and downstream drive roller lower than the tension value at the time of transporting the elongate printing paper, so that at least part of the contact portions of the elongate printing paper in contact with the cooling rollers separate from the cooling rollers. Consequently, gaps can be produced between the contact portions of the elongate printing paper in contact with the cooling rollers and the cooling rollers. This can reduce waterdrops due to dew condensation adhering to the elongate printing paper. As a result, paper break can be inhibited at a time of starting transportation of the elongate printing paper.

It is preferred that the above printing apparatus further comprises ventilators for sending air flows to the elongate printing paper between the upstream drive roller and the downstream drive roller, wherein the controller operates the ventilators to send the air flows to the elongate printing paper at the time of transportation halt of the elongate printing paper, so that the contact portions of the elongate printing paper in contact with the cooling rollers separate from the cooling rollers. This facilitates formation of the gaps between the contact portions of the elongate printing paper in contact with the cooling rollers and the cooling rollers. Consequently, waterdrops due to dew condensation are less likely to adhere to the elongate printing paper, thereby inhibiting paper break. The air flows sent from the ventilators blow moisture away from the elongate printing paper or from around the cooling rollers. This can reduce the possibility of dew condensation and inhibit paper break.

In the above printing apparatus it is preferred that the controller, by controlling the upstream drive roller and the downstream drive roller before starting printing on the elongate printing paper, starts transportation of the elongate printing paper with a tension value of the elongate printing paper made lower than a tension value at a time of printing on the elongate printing paper. This can reduce the load on the elongate printing paper at the time of transportation start, and inhibit paper break.

In the above printing apparatus it is preferred that, after ending printing on the elongate printing paper, the controller causes the upstream drive roller and the downstream drive roller to transport the elongate printing paper heated by the drying unit so that the elongate printing paper pass through the cooling rollers, while stopping or easing the cooling by the cooling rollers. With this, since the cooling rollers are warmed, the chance of dew condensation can be reduced.

It is preferred that the above printing apparatus further comprises a tension sensor for detecting the tension value of the elongate printing paper between the upstream drive roller and the downstream drive roller; wherein the controller controls the upstream drive roller and the downstream drive roller based on a detection value provided by the tension sensor. With this, the tension value of the elongate printing paper between the upstream drive roller and the downstream drive roller can be regulated based on a tension value actually detected by the tension sensor.

In the above printing apparatus it is preferred that the controller makes the tension value of the elongate printing paper lower than the tension value at the time of transporting the elongate printing paper by controlling both the upstream drive roller and the downstream drive roller. The tension value can therefore be lowered from the two directions of the upstream drive roller and the downstream drive roller. This facilitates a uniform formation of the gaps between the contact portions of the elongate printing paper in contact with the cooling rollers and the cooling rollers.

In another aspect of this invention, an elongate printing paper transporting method is provided for a printing apparatus having a printing unit, a drying unit, a plurality of cooling rollers, an upstream drive roller located in a position upstream of and adjacent the cooling rollers for transporting the elongate printing paper, and a downstream drive roller located downstream of and adjacent the cooling rollers. The elongate printing paper transporting method comprises a transporting step for transporting the elongate printing paper by the upstream drive roller and the downstream drive roller; a printing step for printing by the printing unit on the elongate printing paper transported; a step of heating and drying, by the drying unit, print portions of the elongate printing paper printed by the printing unit; a step of cooling, by the cooling rollers, the print portions dried by the drying unit; and a transportation halting step for halting transportation of the elongate printing paper after completion of the printing on the elongate printing paper by the printing unit; wherein, at a time of the transportation halting step, at least one of the upstream drive roller and the downstream drive roller is controlled to make a tension value of the elongate printing paper between the upstream drive roller and the downstream drive roller lower than a tension value at a time of the transporting step, so that at least part of contact portions of the elongate printing paper in contact with the cooling rollers separate from the cooling rollers.

According to the elongate printing paper transporting method in this invention, at least one of the upstream drive roller and downstream drive roller is operated, after the end of printing on the elongate printing paper and at the time of transportation halt of the elongate printing paper, to make the tension value of the elongate printing paper between the upstream drive roller and downstream drive roller lower than the tension value at the time of the transporting step (at the time of transporting the elongate printing paper), so that at least part of the contact portions of the elongate printing paper in contact with the cooling rollers separate from the cooling rollers. Consequently, gaps can be produced between the contact portions of the elongate printing paper in contact with the cooling rollers and the cooling rollers. This can reduce waterdrops due to dew condensation adhering to the elongate printing paper. As a result, paper break can be inhibited at the time of starting transportation of the elongate printing paper.

Advantageous Effects of Invention

The printing apparatus and the elongate printing paper transporting method for a printing apparatus according to this invention can inhibit paper break due to dew formation.

BRIEF DESCRIPTION OF THE DRAWINGS

For the purpose of illustrating the invention, there are shown in the drawings several forms which are presently preferred, it being understood, however, that the invention is not limited to the precise arrangement and instrumentalities shown.

EMBODIMENT 1

Figure 1:
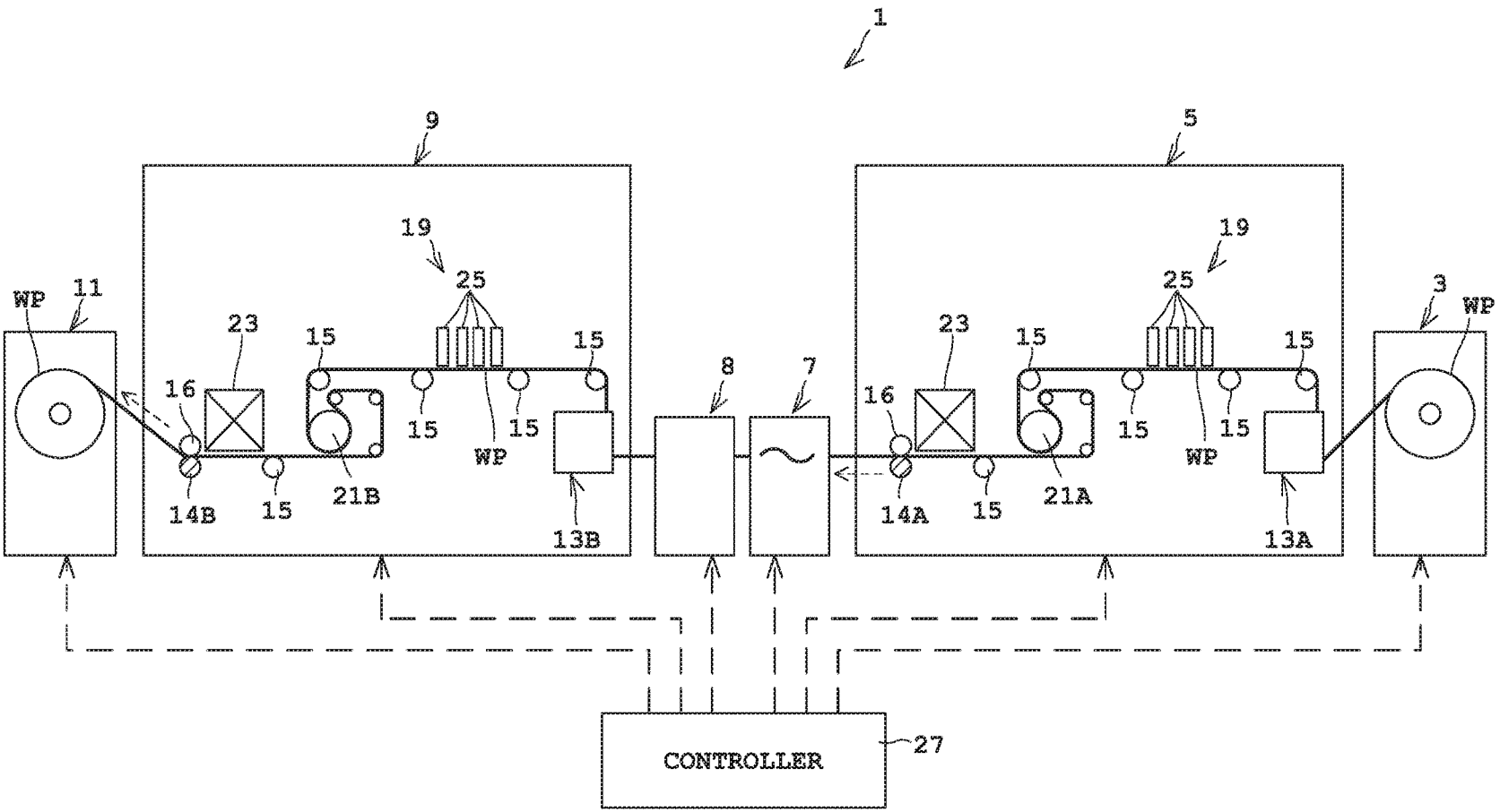
FIG. 1 is an outline schematic view of an inkjet printing apparatus according to Embodiment 1.

Embodiment 1 of this invention will be described hereinafter with reference to the drawings. An inkjet printing apparatus 1 will be described as an example of printing apparatus. FIG. 1 is an outline schematic view of the inkjet printing apparatus 1.

<Construction of Inkjet Printing Apparatus 1>

Reference is made to FIG. 1. The inkjet printing apparatus 1 includes a paper feeder 3, a front surface printer 5, an inverting mechanism 7, a cooling unit 8, a back surface printer 9, and a takeup roller 11.

The paper feeder 3 holds a roll of web paper WP to be rotatable about a horizontal axis. The paper feeder 3 feeds the web paper WP from the roll of web paper WP to the front surface printer 5. The front surface printer 5 prints on a surface (first surface) of the web paper (or roll paper) WP. The web paper WP corresponds to the elongate printing paper in this invention.

The inverting mechanism 7 turns over the web paper WP from front surface to back surface. The inverting mechanism 7 includes a plurality of turn bars not shown. The cooling unit 8 cools the web paper WP printed by the front surface printer 5 and turned over by the inverting mechanism 7. The back surface printer 9 prints on the back surface (second surface) of the web paper WP. The takeup roller 11 winds up about a horizontal axis the web paper WP printed by the front surface printer 5 and back surface printer 9. The takeup roller 11 has an electric motor for winding up the web paper WP.

The front surface printer 5 has two drive rollers 13A and 14A supported rotatably. The drive roller 13A is a roller for taking in the web paper WP from the paper feeder 3. The drive roller 13A is located in an upstream position inside the front surface printer 5. The web paper WP taken in from the paper feeder 3 by the drive roller 13A is transported downstream along a plurality of transport rollers 15 in the front surface printer 5. The drive roller 14A is located in a most downstream position inside the front surface printer 5. The two drive rollers 13A and 14A have electric motors, respectively. On the other hand, the transport rollers 15 have no electric motors, respectively, and cannot apply power to the web paper WP. Sign 16 is a nip roller. The web paper WP is, for example, pinched between the drive roller 14A and nip roller 16. The transport rollers 15 and nip roller 16 are each rotatably supported.

Between the two drive rollers 13A and 14A are a printing unit 19, a heating roller 21A, and an inspection unit 23 arranged in order from upstream.

The printing unit 19 has four print heads 25 of the inkjet type. That is, the printing unit 19 includes a first print head 25 for black (K), a second print head 25 for cyan (C), a third print head 25 for magenta (M), and a fourth print head 25 for yellow (Y). Each print head 25 dispenses ink droplets. The print heads 25 are arranged at predetermined intervals along the transport direction of the web paper WP. The number of print heads 25 is not limited to four, but may be one, two or more (e.g. six).

The heating roller 21A has a built-in heat source (heater). The heating roller 21A heats and dries print portions of the web paper WP printed by the printing unit 19. That is, the heating roller 21A heats the web paper WP wound on the outer circumferential surface of the heating roller 21A to dry the print portions (printed surface) of the web paper WP. The temperature of the outer circumferential surface of the heating roller 21A is set to 100° C., for example. The heating roller 21A has an electric motor to function also as drive roller. The inspection unit 23 has a CCD sensor or CIS sensor (Contact Image Sensor), for example. The inspection unit 23 inspects images (characters or graphics) printed on the web paper WP.

The back surface printer 9 has the same construction as the front surface printer 5. That is, the back surface printer 9 has two drive rollers 13B and 14B, a plurality of transport rollers 15, a printing unit 19, a heating roller 21B, and an inspection unit 23. A description of the components (e.g. signs 13B, 14B and 21B) is omitted. Note that the back surface printer 9 may have a different construction to the front surface printer 5. The heating rollers 21A and 21B correspond to the drying unit in this invention.

A description of the front surface printer 5 and back surface printer 9 will now be added. The components of the front surface printer 5 and back surface printer 9 carry out processes in order on the web paper WP transported. The printing units 19 take turns to perform printing on the web paper WP transported. The heating rollers 21A and 21B take turns to dry, by heating, the web paper WP transported. The inspection units 23 take turns to perform inspection of the web paper WP transported. The inverting mechanism 7 takes its turn to perform a turn-over process on the web paper WP transported. The cooling unit 8 takes its turn to cool the web paper WP transported.

The inkjet printing apparatus 1 has one, two or more controller(s) 27, and a storage unit (at least one of memory and storage) not shown. The controller 27 has a central processing unit (CPU). The controller 27 controls each component (e.g. the front surface printer 5, cooling unit 8, and back surface printer 9) of the inkjet printing apparatus 1. The storage unit stores an operating program of the inkjet printing apparatus 1.

<Construction of Cooling Unit 8>

Figure 2:
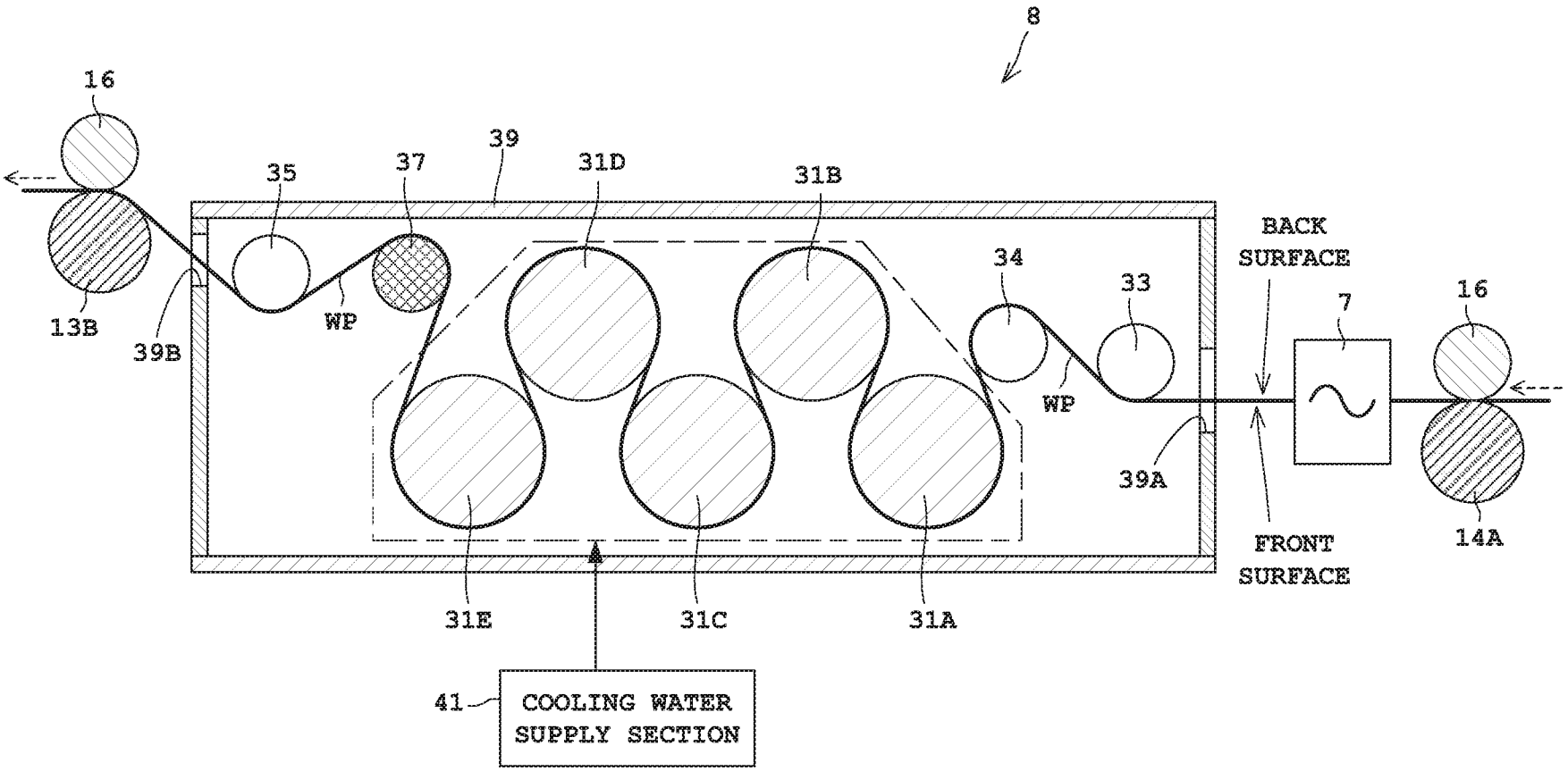
FIG. 2 is a view showing a cooling unit, an upstream drive roller, a downstream drive roller, and so on according to Embodiment 1.

FIG. 2 is a view showing the cooling unit 8, the drive roller 14A located upstream, the drive roller 13B located downstream, and so on. As shown in FIG. 2, the cooling unit 8 has five (a plurality of) cooling rollers 31A-31E, three transport rollers 33, 34 and 35, a tension roller 37, a housing 39, and a cooling water supply section 41. The three transport rollers 33, 34 and 35 and five cooling rollers 31A-31E are supported to be rotatable about axes. Two transport rollers 33 and 34 are located upstream of the five cooling rollers 31A-31E. The transport roller 35 and tension roller 37 are located downstream of the five cooling rollers 31A-31E. The five cooling rollers 31A-31E will be called cooling rollers 31A-31E or cooling rollers 31 as appropriate hereinafter.

The web paper WP turned over by the inverting mechanism 7 is loaded into the cooling unit 8 through an inlet 39A formed in the housing 39. The two transport rollers 33 and 34 guide the web paper WP loaded in through the inlet 39A to the cooling roller 31A.

The five cooling rollers 31A-31E are in a zigzag (stagger) arrangement as shown in FIG. 2. The five cooling rollers 31A-31E are arranged in the order of cooling rollers 31A, 31B, 31C, 31D and 31E from adjacent the inlet 39A. The web paper WP is wound around the five rolling rollers 31A-31E in a way to make a detour around each of the five cooling rollers 31A-31E in the above order.

How the web paper WP is wound around the cooling rollers 31A-31E will be described further. The web paper WP is turned over by the inverting mechanism 7 located upstream of the cooling unit 8. Consequently, the front surface (first surface) of the web paper WP is turned to face down in FIG. 2. On the other hand, the back surface (second surface) of the web paper WP is turned to face up in FIG. 2. The three cooling rollers 31A, 31C and 31E contact the back surface of the web paper WP. The two cooling rollers 31B and 31D contact the front surface of the web paper WP. The three cooling rollers 31A, 31C and 31E and two cooling rollers 31B and 31D are arranged alternately, one after the other.

The cooling rollers 31A-31E are the water cooling type. That is, the cooling rollers 31A-31E are constructed to have their own roller bodies cooled by cooling water passing therethrough. The cooling water supply section 41 supplies the cooling water to the cooling rollers 31A-31E. The cooling water supply section 41 has piping and a pump, for example. Each of the cooling rollers 31A-31E is set to a temperature lower than room temperature (e.g. a temperature 10 deg C. lower than room temperature) in which the apparatus 1 is installed.

The five cooling rollers 31A-31E cool the print portions of the web paper WP heated by the heating roller 21. The transport roller 35 and tension roller 37 guide the web paper WP cooled by the cooling rollers 31A-31E from the cooling roller 31E to an outlet 39B of the housing 39.

The transportation of the web paper WP between the front surface printer 5 and back surface printer 9 is executed by the drive roller 14A of the front surface printer 5 and the drive roller 13B of the back surface printer 9. The drive roller 14A of the front surface printer 5 corresponds to the upstream drive roller in this invention. The drive roller 13B of the back surface printer 9 corresponds to the downstream drive roller in this invention.

The drive roller 14A is located in a position upstream of the five cooling rollers 31A-31E and adjoining the five cooling rollers 31A-31E. The drive roller 14A is located closer than the drive roller 13A and heating roller 21A, that is closest, to the five cooling rollers 31A-31E. On the other hand, the drive roller 13B is located in a position downstream of the five cooling rollers 31A-31E and adjoining the five cooling rollers 31A-31E. The drive roller 13B is located closer than the heating roller 21A and drive roller 14B, that is closest, to the five cooling rollers 31A-31E.

The tension roller 37 detects a tension value (kg: kilogram) of the web paper WP between the drive roller 14A of the front surface printer 5 and the drive roller 13B of the back surface printer 9. The tension roller 37 contacts the web paper WP transported. The tension roller 37 is supported to be rotatable about an axis, and has a strain gauge, for example. By controlling at least one of the drive roller 14A and drive roller 13B based on a detection value (tension value) detected by the tension roller 37, the controller 27 regulates the tension value of the web paper WP between the drive roller 14A and drive roller 13B. The controller 27 regulates the above tension value by changing the rotating speed (rpm) of the drive roller 14A relative to the drive roller 13B, for example. The tension roller 37 corresponds to the tension sensor in this invention.

A tension value of the web paper WP between the drive roller 14A and heating roller 21A is detected by a tension roller (not shown) provided between the drive roller 14A and heating roller 21A. Similarly, a tension value of the web paper WP between the heating roller 21A and drive roller 13A is detected by a tension roller (not shown) provided between the heating roller 21A and drive roller 13A.

Next, the characterizing portion of this invention will be described. The web paper WP heated by the heating roller 21A of the front surface printer 5 reaches a high temperature. The cooling rollers 31A-31E are therefore useful in being capable of cooling the hot web paper WP. However, the cooling rollers 31A-31E are set to a temperature lower than the temperature of the room in which the inkjet printing apparatus 1 is installed. Consequently, dew condensation occurs to the cooling rollers 31A-31E. Especially when the transportation of the web paper WP comes to a halt after printing is completed, dew condensation is still easier to occur under the influence of the heat of the web paper WP and humidity due to the ink droplets. While the transportation of the web paper WP is stopped, waterdrops from the dew condensation continue adhering to contact portions of the web paper WP in contact with the cooling rollers 31A-31E. As a result, there is a possibility of paper break occurring at a time of starting transportation of the web paper WP.

So, the inkjet printing apparatus 1 in this embodiment is constructed to take measures against dew condensation as follows.

When the transportation of the web paper WP comes to a halt after printing on the web paper WP is completed, the controller 27 controls at least one of the upstream drive roller 14A and downstream drive roller 13B. This control is done to make the tension value of the web paper WP between the drive roller 14A and drive roller 13B lower than a tension value at a time of transporting the web paper WP, whereby at least part of the contact portions of the web paper WP in contact with the five cooling rollers 31A-31E separate from the five cooling rollers 31A-31E.

Before start of printing on the web paper WP, the controller 27 starts transportation of the web paper WP, with the upstream drive roller 14A and downstream drive roller 13B making the tension value of the web paper WP lower than the tension value at a time of printing on the web paper WP.

<Operation of Inkjet Printing Apparatus 1>

Next, operation of the inkjet printing apparatus 1, and especially operation according to this invention for inhibiting paper break due to dew condensation, will be described. Reference is made to FIG. 1.

A basic operation for printing will be described. The paper feeder 3 feeds the web paper WP to the front surface printer 5. The two drive rollers 13A and 14A and the heating roller 21A of the front surface printer 5 transport the web paper WP with the power of each roller. The web paper WP is transported to the printing unit 19, heating roller 21A, and inspection unit 23 in this order. Similarly, the two drive rollers 13B and 14B and the heating roller 21B of the back surface printer 9 transport the web paper WP with the power of each roller.

The printing unit 19 prints on predetermined portions of the web paper WP when the predetermined portions of the web paper WP pass each print head 25 of the printing unit 19. Subsequently, the print portions (predetermined portions of the web paper WP) printed by the printing unit 19 pass the heating roller 21A while being wound around the heating roller 21A. At this time, the heating roller 21A heats and dries the print portions printed by the printing unit 19.

The inspection unit 23 inspects the print portions when the print portions heated by the heating roller 21A pass through the inspection unit 23. Then, the print portions heated by the heating roller 21A pass the drive roller 14A (upstream drive roller), and further, after being turned over by the inverting mechanism 7, the web paper WP is transported to the cooling unit 8.

In FIG. 2, the print portions heated by the heating roller 21A pass the cooling rollers 31A-31E while being wound around the cooling rollers 31A-31E. At this time, the cooling rollers 31A-31E cool the print portions heated by the heating roller 21A. The print portions of the web paper WP cooled by the cooling rollers 31A-31E of the cooling unit 8 are fed to the back surface printer 9, and pass the drive roller 13B (downstream drive roller) of the back surface printer 9.

After a final front surface printing is done for the predetermined portions by the printing unit 19 in the front surface printer 5, the printing unit 19 of the back surface printer 9 carries out a final back surface printing on the back surface of a final front surface print portion. Subsequently, the web paper WP is transported until the final back surface print portion is wound on the takeup roller 11.

Figure 3:
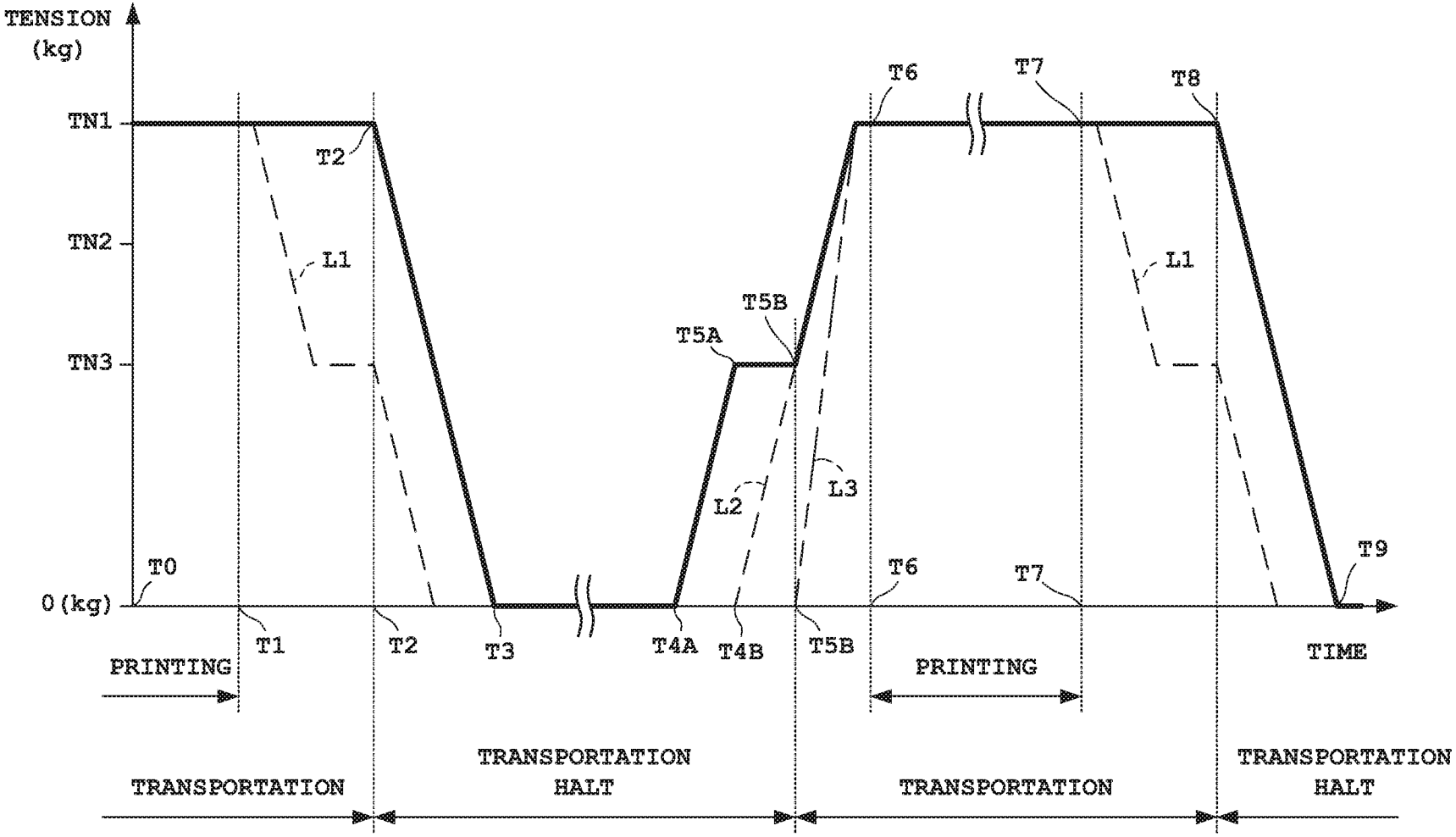
FIG. 3 is a time chart showing variations of a tension value of web paper between the upstream drive roller and downstream drive roller.

Reference is made to FIG. 3. FIG. 3 is a time chart showing variations in the tension value of the web paper WP between the upstream drive roller 14A and downstream drive roller 13B. In FIG. 3, a solid line shows the tension value in this embodiment. Broken lines L1 and L2 and a two-dot chain line L3 show tension values in modifications of this embodiment.

At time T0, the printing unit 19 of at least one of the front surface printer 5 and back surface printer 9 is engaged in printing on the web paper WP transported. The tension value at this time is TN1. The printing by the printing unit 19 of each of the front surface printer 5 and back surface printer 9 ends (stops) at time T1. At this time, the four drive rollers 13A, 13B, 14A and 14B and two heating rollers 21A and 21B continue transporting the web paper WP.

Before time T2 the drive roller 13A and other rollers start decelerating the web paper WP, and at time T2 the drive roller 13A and other rollers stop transporting the web paper WP. While the web paper WP is in deceleration, the tension value is maintained at TN1. After stopping the transportation of the web paper WP, the controller 27 makes the tension value of the web paper WP between the drive roller 14A and drive roller 13B lower than tension value TN1 at the time of transporting and decelerating the web paper WP. As indicated by broken line L1 shown in FIG. 3, tension value TN1 may be reduced to tension value TN3 before time T2, and may be further reduced from tension value TN3 at and after time T2.

The controller 27 can reduce the tension value of the web paper WP by operating at least one of the drive roller 14A and drive roller 13B. In FIG. 2, for example, the tension value of the web paper WP can be reduced by operating the upstream drive roller 14A to transport the web paper WP toward the cooling unit 8 with the downstream drive roller 13B having stopped transporting the web paper WP.

It is also possible to operate both the drive roller 14A and drive roller 13B for reducing the tension value. In FIG. 2, for example, the controller 27 transports the web paper WP by making the transporting speed of the upstream drive roller 14A higher than that of the downstream drive roller 13B. Alternatively, the tension value of the web paper WP can be reduced by causing the downstream drive roller 13B to transport the web paper WP upstream (or backward toward the cooling unit 8) while the upstream drive roller 14A transports the web paper WP downstream.

At time T3, the tension value of the web paper WP between the drive rollers 14A and 13B becomes 0 (zero) kg or less. At least part of the contact portions of the web paper WP contacting the cooling rollers 31A-31E separate from the cooling rollers 31A-31E around time T3. At this time, in the front surface printer 5, for example, the tension value of the other portions of the web paper WP, i.e. the tension value of the web paper WP between the drive roller 13A and heating roller 21A or between the heating roller 21A and drive roller 14A is not 0 kg but tension value TN2. Tension value TN2 is smaller than tension value TN1 and larger than tension value TN3, for example.

Figure 4:
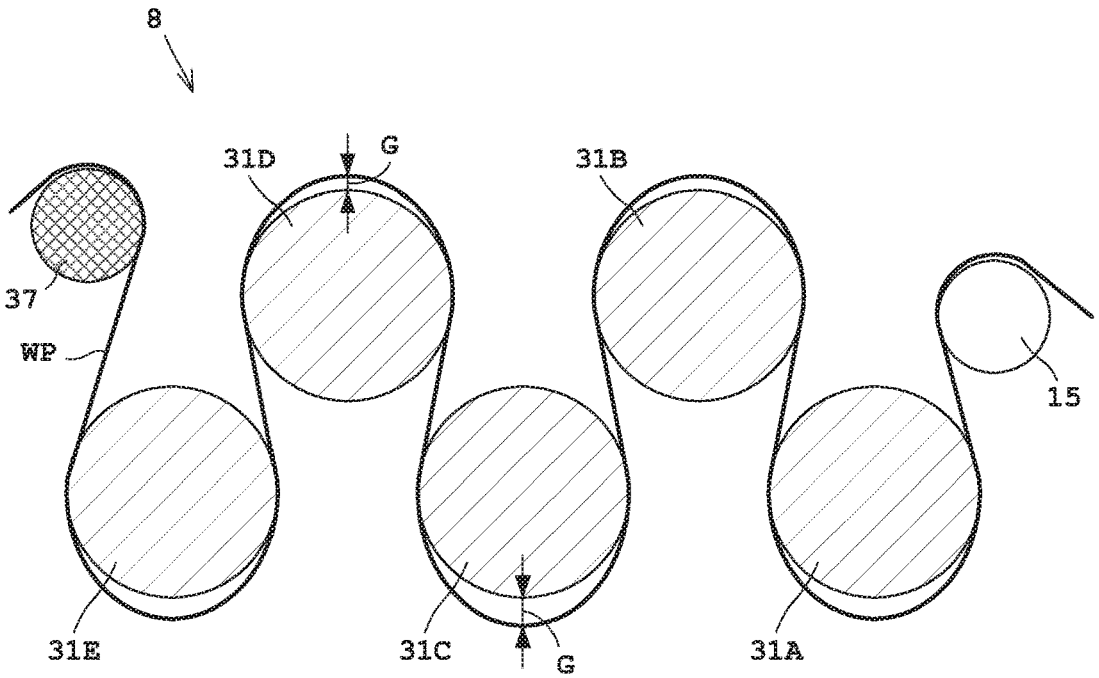
FIG. 4 is a view illustrating operation of the inkjet printing apparatus according to Embodiment 1.

FIG. 4 is a schematic view showing a positional relationship between the cooling rollers 31A-31E and web paper WP around time T3. As noted above, when the transportation of the web paper WP is at a standstill, the controller 27 reduces the tension value of the web paper WP to 0 kg or less from tension value TN1 at the time of transportation. Consequently, the web paper WP becomes slack, and part of the contact portions of the web paper WP separate from the cooling rollers 31A-31E, producing gaps G between the web paper WP and cooling rollers 31A-31E. This decreases an area of contact between the cooling rollers 31A-31E and web paper WP. As a result, waterdrops due to dew condensation adhering to the web paper WP can be lessened.

When operating both of the two drive rollers 14A and 13B to reduce the tension value, the tension value of the web paper WP can be lowered from both upstream and downstream sides of the cooling rollers 31A-31E. In this case, the web paper WP can be loosened evenly relative to the cooling rollers 31A-31E.

At time T5B, the controller 27 resumes transportation of the web paper WP. At time T4A before resuming transportation of the web paper WP, the controller 27 raises the tension value of the web paper WP between the drive rollers 14A and 13B from the state of 0 kg or less. The rise of the tension value can be realized by operating at least one of the drive roller 14A and drive roller 13B. For example, the controller 27 can raise the tension value of the web paper WP by operating the downstream drive roller 13B, in a state of the transportation of the web paper WP by the upstream drive roller 14A being suspended, to transport (take) the web paper WP into the back surface printer 9. Note that, in FIG. 3, "transportation" up to time T2 and from time T5B to time T8 refers to movement of the web paper WP toward the takeup roller 11 (downstream) shown in FIG. 1 with all the drive rollers including the four drive rollers 13A, 13B, 14A and 14B and two heating rollers 21A and 21B. Thus, "transportation halt" means not moving the web paper WP toward the takeup roller 11 with all the drive rollers (the four drive rollers 13A, 13B, 14A and 14B and two heating rollers 21A and 21B).

The controller 27 may operate both the drive roller 14A and drive roller 13B to raise the tension value. In this case, for example, the controller 27 operates both the upstream drive roller 14A and downstream drive roller 13B to transport the web paper WP downstream. At this time, the downstream drive roller 13B is rotated at a higher speed than the upstream drive roller 14A to transport the web paper WP faster than the upstream drive roller 14A.

When the tension value of the web paper WP reaches tension value TN3 at time T5A, the controller 27 maintains tension value TN3. And at time T5B, the controller 27 starts transporting the web paper WP in the downstream direction by operating the drive roller 14A, drive roller 13B, and so on. The controller 27 starts printing at time T6. From time T5B to time T6, the controller 27 raises the tension value gradually from TN3 to TN1 by operating at least one of the drive roller 14A and drive roller 13B. Tension value TN3 is a tension value which enables transportation of the web paper WP by the drive roller 14A, drive roller 13B, and so on, and which is set, for example, to less than half of tension value TN1 at the time of starting the printing.

Thus, the controller 27 raises the tension value from 0 kg or less to tension value TN3 for enabling transportation of the web paper WP. And the transportation of the web paper WP is started after tension value TN3 is maintained for a predetermined period (period from time T5A to time T5B). Since the period for maintaining the web paper WP under tension is provided before time T5B for starting transportation of the web paper WP, it is possible to lighten the load on the web paper WP between the upstream drive roller 14A and downstream drive roller 13B, and inhibit paper break.

However, the above period (period from time T5A to time T5B) for maintaining tension may be omitted. In this case, as indicated by broken line L2 shown in FIG. 3, the tension value begins to be raised at time T4B, and the transportation is started immediately upon reaching tension value TN3. Alternatively, as indicated by two-dot chain line L3 shown in FIG. 3, the tension value zero may be raised at time T5B to reach tension value TN1 for printing, almost simultaneously with transportation of the web paper WP After tension value TN1 is reached, printing is started at predetermined time T6, and the printing is ended at time T7. That is, the printing is done by the printing units 19 of the front surface printer 5 and back surface printer 9 during the period of time T6 to time T7. The printing may be started at the transporting time of time T5B. During a period of time T7 to time T8, a back surface print portion of the web paper WP printed last by the back surface printer 9 is taken up by the takeup roller 11. The print portions move through the cooling unit 8 at tension value TN1 during the period of time T6 to time T8. The transportation of the web paper WP comes to a halt at time T8, as at time T2. The operations at times T8 and T9 are the same as those at times T2 and T3. From time T9 and onward, the operations at times T3-T9 are repeated.

According to this embodiment, at least one of the upstream drive roller 14A and downstream drive roller 13B is operated, after the end of printing on the web paper WP and at the time of transportation halt of the web paper WP, to make the tension value of the web paper WP between the drive roller 14A and drive roller 13B lower than the tension value a the time of transporting the web paper WP, so that at least part of the contact portions of the web paper WP in contact with the five cooling rollers 31A-31E separate from the five cooling rollers 31A-31E. Consequently, gaps can be produced between the contact portions of the web paper WP in contact with the five cooling rollers 31A-31E and the five cooling rollers 31A-31E. That is, the web paper WP can be made slack. This can reduce waterdrops due to dew condensation adhering to the web paper WP, and can avoid the web paper WP contacting the five cooling rollers 31A-31E as much as possible. As a result, paper break can be inhibited at the time of starting transportation of the web paper WP.

The controller 27, by controlling the drive roller 14A and drive roller 13B before starting printing on the web paper WP, starts transportation of the web paper WP with the tension value of the web paper WP made lower than tension value TN1 at the time of printing on the web paper WP. This can reduce the load on the web paper WP at the time of transportation start, and inhibit paper break.

EMBODIMENT 2

Next, Embodiment 2 of this invention will be described with reference to the drawings. Descriptions overlapping Embodiment 1 will be omitted. In Embodiment 1, as shown in FIG. 4, the tension value of the web paper WP between the drive roller 14A and drive roller 13B is made lower than the tension value at the time of transporting the web paper WP, so that at least part of the contact portions of the web paper WP in contact with the cooling rollers 31A-31E separate from the cooling rollers 31A-31E.

In addition, in Embodiment 2, ventilators 51A-51E send air flows to the web paper WP to separate the contact portions of the web paper WP in contact with the cooling rollers 31A-31E from the cooling rollers 31A-31E.

Figure 5:
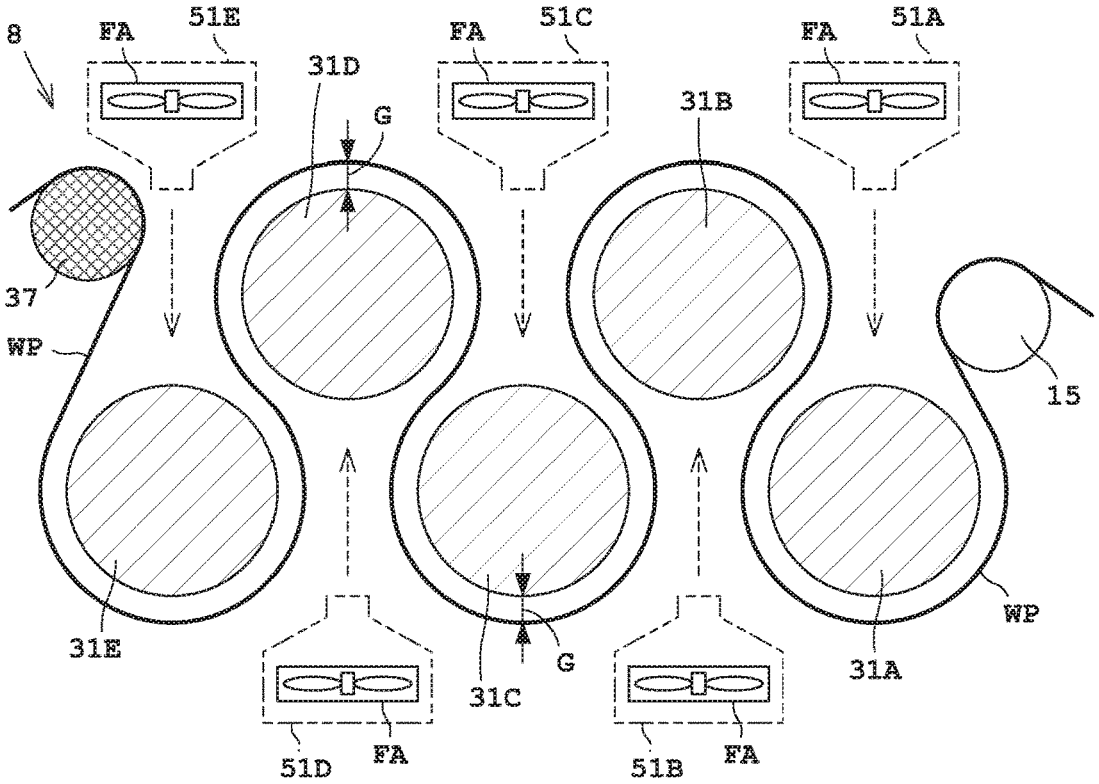
FIG. 5 is a view showing a cooling unit with ventilators according to Embodiment 2.

FIG. 5 is a view showing Embodiment 2 in which the cooling unit 8 has ventilators (blowing sections) 51A-51E. In addition to the construction of Embodiment 1 shown in FIG. 2, the cooling unit 8 has five ventilators 51A-51E. The five ventilators 51A-51E correspond to the five cooling rollers 31A-31E. For example, the ventilator 51A corresponds to the cooling roller 31A. The ventilator 51B corresponds to the cooling roller 31B. The ventilator 51E corresponds to the cooling roller 31E.

In FIG. 5, the five ventilators 51A-51E each have one fan (blower) FA. In this respect, instead of each of the five ventilators 51A-51E having one fan FA, air flows produced by one fan FA may be sent to two or more ventilators (e.g. two ventilators 51A and 51B). The fans FA are driven by an electric motor. A current speed or air volume of the air flows produced by the fans FA is set arbitrarily. Each of the five ventilators 51A-51E has a nozzle or guide not shown, and sends the air flow in an arbitrary direction. For example, the air flow by the ventilator 51A is sent to the web paper WP from adjacent the cooling roller 31A. That is, the ventilator 51A sends the air flow to the web paper WP so that the contact portion of the web paper WP in contact with the cooling roller 31A may separate from the cooling roller 31A.

At time T2 in FIG. 3, the transportation of the web paper WP is stopped. After stopping the transportation of the web paper WP, the controller 27 controls at least one of the upstream drive roller 14A and downstream drive roller 13B to make the tension value of the web paper WP between the drive roller 14A and drive roller 13B lower than the tension value at the time of transporting the web paper WP, whereby at least part of the contact portions of the web paper WP in contact with the cooling rollers 31A-31E separate from the cooling rollers 31A-31E. When the tension value of the web paper WP between the drive rollers 14A and 13B is made 0 kg or less, the tension value is a value not influenced by the air flows.

With arbitrary timing at the time of the transportation halt of the web paper WP, the controller 27 operates the five ventilators 51A-51E to send the air flows to the web paper WP so that the contact portions of the web paper WP in contact with the five cooling rollers 31A-31E may separate from the five cooling rollers 31A-31E. That is, the controller 27 sends the air flows to the web paper WP from the five ventilators 51A-51E while making the web paper WP slack or after making the web paper WP slack by reducing the tension value of the web paper WP. Consequently, the web paper WP can be separated from the five cooling rollers 31A-31E to produce predetermined gaps G. The air flows sent to the gaps G between the five cooling rollers 31A-31E and web paper W blow moisture away from the gaps G along with moisture of the web paper WP to make the cooling rollers 31A-31E less liable to dew condensation.

According to this embodiment, the air flows sent from the ventilator 51A-51E facilitate formation of the gaps G between the contact portions of the web paper WP in contact with the cooling rollers 31A-31E and the cooling rollers 31A-31E. Consequently, waterdrops due to dew condensation are less likely to adhere to the web paper WP, thereby inhibiting paper break. The air flows sent from the ventilators 51 blow away moisture from the web paper WP or from around the cooling rollers 31A-31E. This can reduce the possibility of dew condensation and inhibit paper break.

Figure 6:
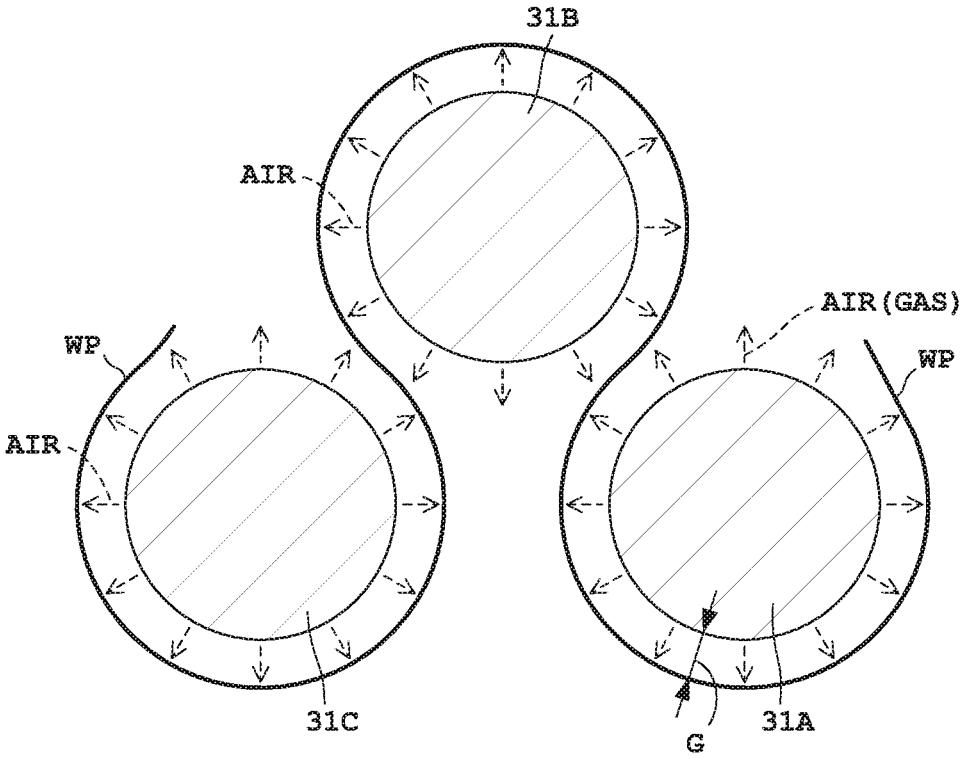
FIG. 6 is a view showing a modification of the ventilators of the cooling unit according to Embodiment 2.

The ventilators 51A-51E shown in FIG. 5 are provided separate from the cooling rollers 31A-31E. In this respect, the cooling rollers 31A-31E may have the ventilators 51A-51E mounted therein. In this case, many ventilating ports are provided, for example, in the outer circumferential surface of the cooling roller 31A. As shown in FIG. 6, a gap G is formed by blowing air flow out of ventilating ports provided in the outer circumferential surface. The other cooling rollers 31B-31E are constructed like the cooling roller 31A.

EMBODIMENT 3

Next, Embodiment 3 of this invention will be described with reference to the drawings. Descriptions overlapping Embodiments 1 and 2 will be omitted. In Embodiments 1 and 2, as shown in FIGS. 4 and 5, the tension value of the web paper WP between the drive roller 14A and drive roller 13B is made lower than the tension value at the time of transporting the web paper WP, so that at least part of the contact portions of the web paper WP in contact with the cooling rollers 31A-31E separate from the cooling rollers 31A-31E. In addition to Embodiment 1 or Embodiment 2, Embodiment 3 may have the following construction.

After ending (stopping) printing on the web paper WP, the controller 27 causes the drive roller 14A and drive roller 13B, and other rollers such as the drive roller 13A and heating roller 21B, to transport the web paper WP heated by the heating roller 21A so that the web paper WP pass through the cooling rollers 31A-31E, while stopping or easing the cooling by the five cooling rollers 31A-31E. The easing is not turning off the cooling function of the cooling rollers 31A-31E, but setting a temperature (e.g. temperature 5° C. lower than room temperature) higher than a set temperature of a usual printing time.

Figure 7:
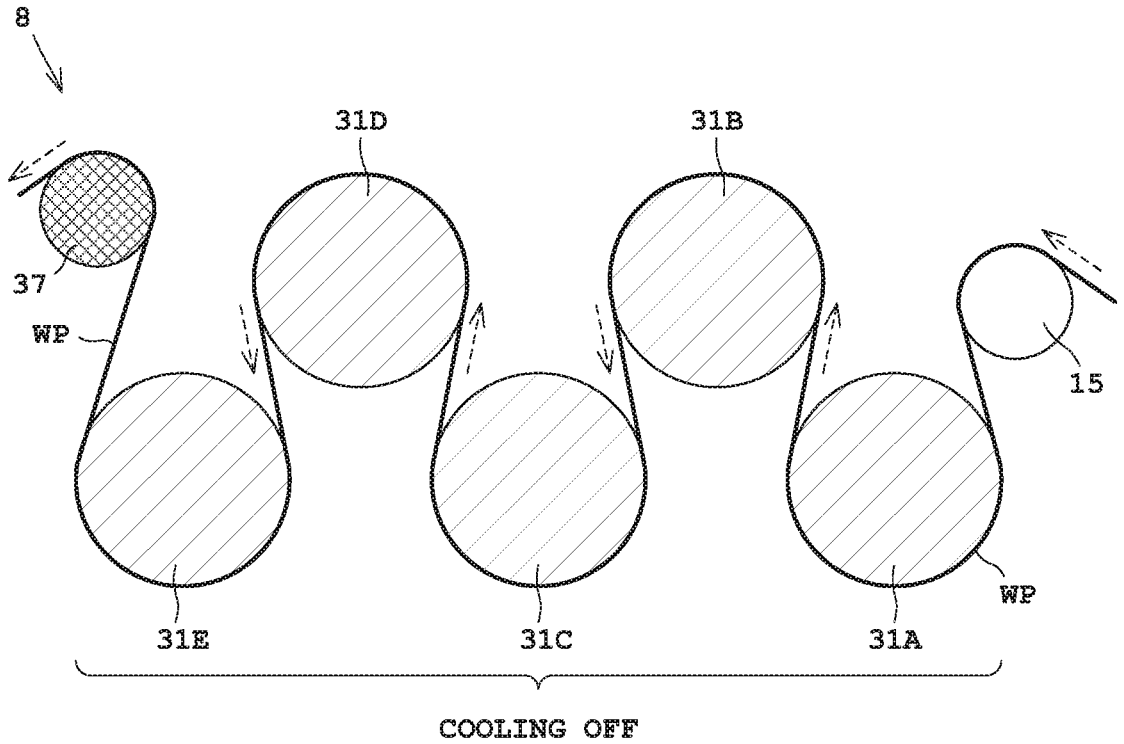
FIG. 7 is a view illustrating operation of an inkjet printing apparatus according to Embodiment 3.

This will be specifically described with reference to FIG. 7. First, at a time of transporting the web paper WP after printing on the web paper WP, the cooling by the cooling rollers 31A-31E is stopped (cooling OFF). That is, the supply of cooling water by the cooling water supply section 41 is stopped. Then, the drive roller 14A, drive roller 13B and so on transport the web paper WP heated by the heating roller 21A. By this transportation, the web paper WP heated by the heating roller 21A is passed through the cooling rollers 31A-31E. At this time, the cooling rollers 31A-31E are warmed by the web paper WP heated by the heating roller 21A. This can reduce the chance of dew condensation occurring to the cooling rollers 31A-31E.

The transportation of the heated web paper WP is conducted until the cooling rollers 31 substantially reach room temperature or above, for example. In this case, the web paper WP is transported for a period of time set beforehand, or based on a temperature detected by a temperature sensor provided for the cooling rollers 31A-31E. After warming the cooling rollers 31A-31E, the transportation of the heated web paper WP comes to a halt.

Since the cooling rollers 31A-31E are warmed according to this embodiment, the chance of dew condensation can be reduced.

This invention is not limited to the foregoing embodiments, but may be modified as follows:

(1) In each foregoing embodiment, the cooling unit 8 has the tension roller 37. As occasion demands, the cooling unit 8 does not need to have the tension roller 37. In this case, the controller 27 operates at least one of the upstream drive roller 14A and downstream drive roller 13B based on a procedure of operation set beforehand (i.e. by open-loop control).

(2) In each foregoing embodiment and modification (1) above, in FIG. 2, for example, the tension roller 37 is located downstream of the five cooling rollers 31A-31G. In this respect, the tension roller 37 may be located upstream of the five cooling rollers 31A-31G. In this case, the transport roller 34 shown in FIG. 2, for example, may be a tension roller, and the tension roller 37 may be a transport roller. Both the transport roller 34 and tension roller 37 may be tension rollers as necessary.

(3) In each forgoing embodiment and each modification, the front surface printer 5 performs printing on the front surface of the web paper WP. In this respect, the front surface printer 5 may perform printing on the back surface of the web paper WP. Further, in FIG. 1, the positions of the front surface printer 5 and back surface printer 9 may be exchanged.

(4) In each forgoing embodiment and each modification, in FIG. 1, the arrangement of the inverting mechanism 7 and cooling unit 8 may be reversed. That is, the web paper WP transported from the front surface printer 5 may be turned over from front surface to back surface by the inverting mechanism 7 after being cooled by the cooling unit 8.

(5) In each forgoing embodiment and each modification, the heating rollers 21A and 21B heat and dry the print portions of the web paper WP printed by the printing units 19. The heating rollers 21A and 21B may be replaced with drive rollers and warm air blasting mechanisms (having heaters and fans). In this case, warm air is blown to the web paper WP transported while winding around the drive rollers provided as replacement. This effects drying of the print portions.

(6) In each forgoing embodiment and each modification, after stopping printing at time T1, the web paper WP not printed but heated by the heating roller 21A may be passed through the cooling rollers 31A-31E. By passing the additionally dried web paper WP through the cooling rollers 31, dew condensation around the cooling rollers 31 in the cooling units 8 and 61 can be eliminated.

(7) In each forgoing embodiment and each modification, the controller 27 carries out the operation, shown in FIG. 4, for making the web paper WP slack by controlling at least one of the upstream drive roller 14A and downstream drive roller 13B after the printing on the web paper WP and at the time of transportation halt of the web paper WP. In this respect, the controller 27 may carry out the operation, shown in FIG. 4, for making the web paper WP slack before start of the printing on the web paper WP and at the time of transportation halt of the web paper WP.

(8) In each forgoing embodiment and each modification, the cooling unit has the five cooling rollers 31. The number of cooling rollers 31 is not limited to this, but the number of cooling rollers 31 may be less than five (i.e. one or more) or more than five.

(9) In each forgoing embodiment and each modification, the inkjet printing apparatus 1 has the front surface printer 5 and back surface printer 9 for performing duplex printing. In this respect, in order to perform simplex printing, the inkjet printing apparatus 1 may have only the front surface printer 5 and not the back surface printer 9. In this case, the front surface printer 5 includes the cooling unit 8 having the five cooling rollers 31, and the cooling unit 8 is located downstream of the drive roller 14A. The front surface printer 5 further includes the drive roller 13B and nip roller 16 shown in FIG. 2. That is, the cooling unit 8 is located between the drive roller 14A and drive roller 13B. The inspection unit 23, although located between the heating roller 21A and drive roller 14A in FIG. 1, may be located between the drive roller 14A and drive roller 13B in this modification. The inkjet printing apparatus 1 may have the cooling unit 8 in each of the front surface printer 5 and back surface printer 9.

This invention may be embodied in other specific forms without departing from the spirit or essential attributes thereof and, accordingly, reference should be made to the appended claims, rather than to the foregoing specification, as indicating the scope of the invention.

What is claimed is:

1. A printing apparatus for printing on elongate printing paper, comprising:

a printing unit for printing on the elongate printing paper;

a drying unit for heating and drying print portions of the elongate printing paper printed by the printing unit;

a plurality of cooling rollers for cooling the print portions heated by the drying unit;

an upstream drive roller located in a position upstream of and adjacent the cooling rollers for transporting the elongate printing paper;

a downstream drive roller located in a position downstream of and adjacent the cooling rollers for transporting the elongate printing paper; and a controller for making a tension value of the elongate printing paper between the upstream drive roller and the downstream drive roller lower than a tension value at a time of transportation of the elongate printing paper by controlling at least one of the upstream drive roller and the downstream drive roller after the printing on the elongate printing paper and at a time of transportation halt of the elongate printing paper, so that at least part of contact portions of the elongate printing paper in contact with the cooling rollers separate from the cooling rollers.

2. The printing apparatus according to claim 1, further comprising ventilators for sending air flows to the elongate printing paper between the upstream drive roller and the downstream drive roller, wherein the controller operates the ventilators to send the air flows to the elongate printing paper at the time of transportation halt of the elongate printing paper, so that the contact portions of the elongate printing paper in contact with the cooling rollers separate from the cooling rollers.

3. The printing apparatus according to claim 1, wherein the controller, by controlling the upstream drive roller and the downstream drive roller before starting printing on the elongate printing paper, starts transportation of the elongate printing paper with a tension value of the elongate printing paper made lower than a tension value at a time of printing on the elongate printing paper.

4. The printing apparatus according to claim 1, wherein, after ending printing on the elongate printing paper, the controller causes the upstream drive roller and the downstream drive roller to transport the elongate printing paper heated by the drying unit so that the elongate printing paper pass through the cooling rollers, while stopping or easing the cooling by the cooling rollers.

5. The printing apparatus according to claim 1, further comprising a tension sensor for detecting the tension value of the elongate printing paper between the upstream drive roller and the downstream drive roller;

wherein the controller controls the upstream drive roller and the downstream drive roller based on a detection value provided by the tension sensor.

6. The printing apparatus according to claim 1, wherein the controller makes the tension value of the elongate printing paper lower than the tension value at the time of transporting the elongate printing paper by controlling both the upstream drive roller and the downstream drive roller.

7. An elongate printing paper transporting method for a printing apparatus having a printing unit, a drying unit, a plurality of cooling rollers, an upstream drive roller located in a position upstream of and adjacent the cooling rollers for transporting the elongate printing paper, and a downstream drive roller located downstream of and adjacent the cooling rollers, the method comprising:

a transporting step for transporting the elongate printing paper by the upstream drive roller and the downstream drive roller;

a printing step for printing by the printing unit on the elongate printing paper transported;

a step of heating and drying, by the drying unit, print portions of the elongate printing paper printed by the printing unit;

a step of cooling, by the cooling rollers, the print portions dried by the drying unit; and a transportation halting step for halting transportation of the elongate printing paper after completion of the printing on the elongate printing paper by the printing unit;

wherein, at a time of the transportation halting step, at least one of the upstream drive roller and the downstream drive roller is controlled to make a tension value of the elongate printing paper between the upstream drive roller and the downstream drive roller lower than a tension value at a time of the transporting step, so that at least part of contact portions of the elongate printing paper in contact with the cooling rollers separate from the cooling rollers.

* * * * *